United States Patent [19]

Blume

[11] 4,056,992

[45] Nov. 8, 1977

[54] SHEAR FOIL AND METHOD OF MAKING THE SAME

[75] Inventor: Friedrich Blume, Schwalbach, Germany

[73] Assignee: Braun Aktiengesellschaft, Frankfurt am Main, Germany

[21] Appl. No.: 719,143

[22] Filed: Aug. 31, 1976

[30] Foreign Application Priority Data

Sept. 11, 1975 Germany ..... 2540434

[51] Int. Cl.[2] ..... B21K 11/00; B26B 19/04

[52] U.S. Cl. ..... 76/104 R; 30/346.51; 30/346.53

[58] Field of Search ..... 76/104 R; 30/346.51, 30/346.53, 43.92

[56] References Cited

U.S. PATENT DOCUMENTS

| | | | |
|---|---|---|---|
| 3,064,349 | 11/1962 | Futterer et al. | 30/346.53 |
| 3,409,984 | 11/1968 | Futterer | 30/346.51 |
| 3,611,572 | 10/1971 | Futterer | 30/346.51 |
| 3,650,849 | 3/1972 | Nidetzky | 76/104 R |

*Primary Examiner*—Harold D. Whitehead
*Assistant Examiner*—Roscoe V. Parker
*Attorney, Agent, or Firm*—Michael J. Striker

[57] ABSTRACT

A shear foil and method of making the same includes providing a surface of a matrix element with a grid of depressions, and overfilling the depressions with a metallic molding substance so as to form a plurality of metallic inserts each of which overlaps a narrow annular region of the surface which bounds a respective depression filled by the respective insert. A layer of metallic screen-forming substance is thereupon deposited over the metallic inserts so as to form a screen having a plurality of openings which extend to the surface intermediate respectively adjacent inserts. The screen also has a face comprised of annular face portions each of which surrounds one of the inserts and which is juxtaposed with the surface of the matrix element. The deposition of a layer of sealing material over the surface of said screen which faces away from said surface of said matrix element, follows. The matrix element is thereupon separated from the screen and the inserts so as to expose the latter and said face. A layer of wear-resistant substance, such as chromium, is then deposited over the exposed face and inserts. The portion of the wear-resistant layer which is deposited on the inserts and thereupon removed from the screen while the remaining portion of the wear-resistant layer on the annular face portions by separating the inserts from the screen. An additional layer of hydrogen-impermeable substance may also be deposited intermediate the matrix element and the screen.

13 Claims, 7 Drawing Figures

SHEAR FOIL AND METHOD OF MAKING THE SAME

BACKGROUND OF THE INVENTION

The present invention relates to a shear foil and to its method of manufacture and more particularly to such foils which are employed in electrically-operated dry shavers.

Shear foils are constituted with a plurality of apertures and are generally mounted in electric shaver heads and also serve to protect the face of a user from accidentally coming into contact with the sharp cutting edges of the cutting mechanism located in the interior of the shaver. The shear foil is also provided at its side facing the cutting mechanism with counteredges which project in direction towards the cutting mechanism and which cooperate with the aforementioned cutting edges of the latter so as to cut any hair follicles which pass through the apertures intermediate the cutting edges and the counteredges. These respective cooperating edges move relative to each other and are exposed thereby to a high degree of abrassive wear.

It is known in the prior art to manufacture shear foils by coating both sides of a thin metal plate with a photosensitive chrome film and to print a grid pattern on one of these sides. This latter side is then exposed and developed by washing to remove parts of chrome layer. Thereupon an etching bath etches the plate at those portions thereof which are not covered with the film. The etching process is continued until the entire thickness of the metal plate is completely eroded, i.e. until the other coated side is reached. Now, hard material is electrolytically-deposited at the exposed side portions of the metal plate. After removing all of the remaining film on both sides of the plate the screen is comprised of elements whose projecting portions or legs are entirely constituted of the electrolytically-deposited hard material.

As hard material, those skilled in the art generally use metals such as metal carbide which generally contains other metals as binding material. Moreover, one may use hard nickel or hard cobalt for electrodeposition; for example, hard nickel owes its hardness characteristic to impurities, such as sulfur normally contained therein. In the art of shear foils, hard nickel is almost exclusively used. However, such material is unfortunately prone to react and thereby to corrode with atomic hydrogen which is normally generated in the electro-deposition plating baths. The larger the surface to be plated, the stronger is the corrosion effect caused by virtue of the hydrogen presence.

Thus, since the prior art suffers from the drawback of having to build up the entire height of the projecting legs of the screen, it will be appreciated that the rather lengthy time involved in forming such legs and the rather large surface area involved all combine to multiply the deleterious effect caused by the hydrogen. The counteredges thus produced are not sharp, not strong, cannot maintain an edge, are subject to rapid wear, are not long lasting, and are easily prone to breakage.

It is also known in the art of electric shavers to improve cutting efficiency by coating the cutting edges themselves with a hard substance such as diamond, silicon carbide, aluminum oxide, titanium carbide, titanium boride, or titanium nitride. Alloys based on nickel, cobalt or copper are also used. The coating thickness generally lies between 3 and 50 microns, the portion of hard metal material actually used constituting between 5 and 80% by volume of the cutter blades.

It is also known to coat the entire rear surface of the screen with hard metal and to build up a substantial thickness of such hard metal over the entire area of the screen so that it can be later machine-ground away to form the desired cutting edges. As examples of hard metals actually used, it is known to use hard metals comprised of 17% by volume of diamond powder which has an average particle size of 1 micron, and to electrolytically deposit nickel as an additional metal in the proportion of 83% by volume to a thickness of approximately 6 microns. Such prior art approaches suffer from the additional expenses of using expensive extra material, extra machining operations, and the necessity of having to plate over an area of substantial size, as well as the increased deleterious effect generated by the greater presence of hydrogen. Moreover, the additional 6 micron layer of nickel which is used only as a binder does not have acceptable wear-resistance characteristics in the presence of the hydrogen. Very frequently, lubricants must be provided intermediate the cutting edges of the cutting mechanism and the screen foil so as to provide a longer working life for the shaver.

SUMMARY OF THE INVENTION

Accordingly, it is a general object of the present invention to overcome the disadvantages of the prior art.

More particularly, it is an object of the present invention to manufacture a durable and longlasting shear foil.

Furthermore, it is an object of the present invention to increase the wear-resistance of the cutting edges of a shear foil.

Still further, it is an object of the present invention to decrease the friction coefficient between a shear foil and a cutting mechanism of an electric shaver.

In addition, it is an object of the present invention to decrease the danger of breakage of a shear foil.

Still furthermore, it is an object of the present invention to provide a shear foil which can maintain its cutting edges for longer periods of time as compared with the prior art constructions.

It is an additional object of the present invention to substantially reduce the effect of hydrogen damage with respect to the shear foil.

In keeping with these objects and others which will become apparent hereinafter one feature of the invention resides, briefly stated, in a shear foil and a method of making the same which comprises the steps of providing a surface of a matrix element with a grid of depressions; overfilling the depressions with a molding substance so as to form a plurality of inserts each of which overlaps a narrow annular region of the surface which bounds a respective depression filled by the respective insert; depositing a layer of screen-forming substance over said inserts so as to form a screen having a plurality of openings which extends to said surface intermediate respectively adjacent inserts, the screen also having a face comprised of annular face portions each of which surrounds one of said inserts and is juxtaposed with said surface; separating the matrix element from the screen and the inserts so as to expose the latter and said face. The method also comprises the deposition of a layer of wear-resistant substance, such as chromium, over the exposed face and the inserts. Furthermore, the method comprises removing the portion of the wear-resistant layer which is deposited on the inserts while leaving the remaining portion of the wear-resistant layer on the annular face portions by separating the inserts from the screen.

The useage of chromium as wear-resistant substance, rather than nickel which normally contains sulfur impurities, is very advantageous because neither the temperature of nor the hydrogen normally generated by the electrolytic deposition plating baths will react with the chromium so as to corrode the same. At present one can only produce foils out of pure nickel or copper without incurring such corrosion due to the generated hydrogen. However, as noted above, such foils are expensive to produce and have unacceptable cutting characteristics.

The electro-deposition of chromium at substantially only the annular face portions of the screen results in a minimum surface area to be plated. Electro-deposition time is thereby reduced as is the amount of hydrogen, as well as the total amount of the chromium itself which is employed in the method of the invention.

In accordance with another feature of the invention, the chromium layer may extend at least in part into the openings of the screen. This helps the chromium layer to be anchored in place at the end regions of the screen. Furthermore, it is advantageous if the screen apertures extend all the way up to borders of the shear foil itself.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
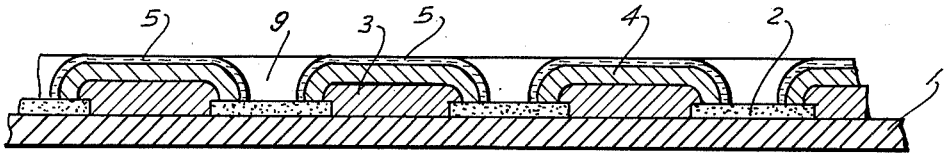
FIG. 1 is a partially broken-away sectional view of the method of the invention at one stage in the process.

Referring jointly to the shear foil itself and to the method of making the same, it will be seen that consistently throughout the drawings, reference numeral 1 identifies a matrix element whose upper metallic surface is provided with a copy of the negative 2 of the foil on the matrix. This pattern corresponding to the negative appearance of the foil to be produced may be formed in many ways.

For example, a plate of suitable metal is covered with a sensitized coating and then a negative in accordance with conventional practice is printed on to the sensitized metal plate by contact printing. The portions of the coating exposed to light are rendered insoluble, and the unexposed portions are left soluble by a suitable solvent, like water. After washing way of the unexposed portions, the exposed areas remain as isles 2 which are slightly raised above the surface of matrix element 1.

Alternatively, the patter of the negative of the foil may be formed by photography with a positive on the sensitized coating which is than developed by washing to leave areas of photoresisting material in those regions corresponding to the apertures of the screen to be formed. In short, no metallic surfaces are etched away, rather the photo-resist material itself is raised above the matrix element. In either of the above-described alternatives, the upper surface of the matrix element is formed with a pattern of raised portions 2 or isles which are separated by a shallow grid shaped recess.

Turning now specifically to FIG. 1, a metallic molding substance 3 is now electro-deposited into the shallow recesses so as to overfill the latter and thereby form a plurality of metallic inserts 3. Each insert 3 has a relatively greater thickness as compared with the height of the isles 2 on the matrix element so that each insert 3 has a flange portion which overlaps a narrow annular region of the surface of the adjacent isles 2 on the matrix element.

Next a layer of metallic screen-forming substance 4 is electro-deposited over the inserts 3 so as to form a screen having a plurality of openings which extend all the way to the matrix surface intermediate respective ones of the adjacent inserts 3. Intermediate these openings the screen 4 is comprised of a plurality of annular screen elements having annular face portions which surround the respective inserts 3. Each screen element has a projecting portion which is formed at its respective free end with a cutting edge region.

If desired, a platinum layer (not illustrated for the sake of clarity) may be electrolytically deposited over the upper side of the screen 4, the side with faces away from the matrix element 1. A layer of sealing material 5 is then coated over the inserts 3 or, if a platinum layer is present, over the latter. FIG. 1 diagramatically illustrates the method of the invention after all of the above-described steps have been completed.

Figure 2:
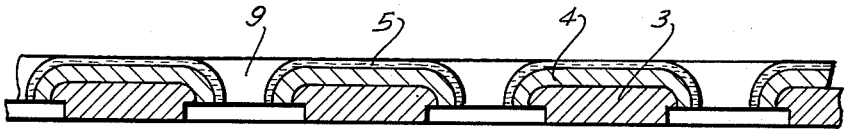
FIG. 2 is a partially broken-away sectional view of the method at another stage of the process.

Turning now to FIG. 2, the method comprises as a decisive measure the step of separating the matrix element 1 with the isles 2 from the screen 4 including the inserts 3 only now, so as to expose the underside of the latter and the annular face portions of the screen which face towards the surface of the matrix element 1.

Figure 3:
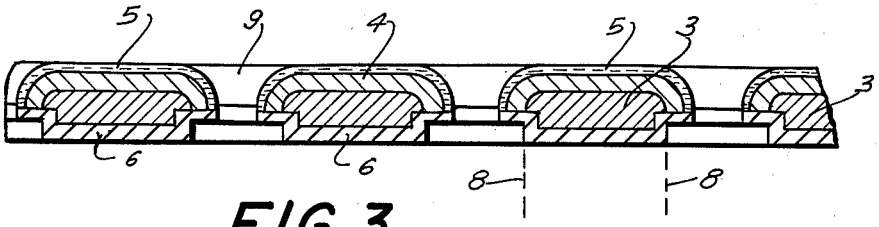
FIG. 3 is a partially broken-away sectional view of the method at still another stage of the process.

Next, the exposed part of the screen and of the inserts, i.e., the lower side which is not covered with sealing material 5, is electrolytically coated — preferentially after an activation — with a layer of metallic wear-resistant substance 6, as shown in FIG. 3. Preferably, the metallic wear-resistant substance 6 is chrome and is built up to a thickness of at least 1 and at most 5 microns. A small portion of the sealing material coat 5 is removed from the end regions of the projecting portions so that a chrome lip is also permitted to extend at least in part into the hole 9, thereby anchoring the chrome layer. Then, the rest of the sealing material coat 5 is removed.

Figure 4:
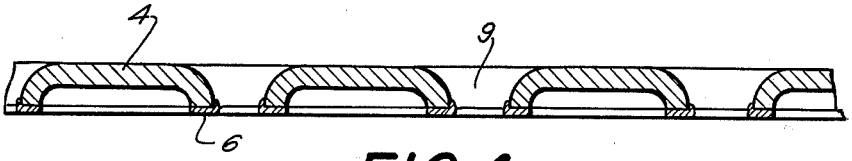
FIG. 4 is a partially broken-away sectional view of the shear foil in accordance with the present invention.

Subsequently the inserts 3 are separated from the screen 4 as shown in FIG. 3, along the separation lines 8. It has been found that a smooth separation results along these imaginary lines 8. Thus, the portion of the wear-resistant layer 6 which was deposited on the exposed side of the inserts 3 is removed from the screen while the remaining portion of the wear-resistant layer 6 is left on the annular face portions. FIG. 4 shows the completed shear foil.

In accordance with another feature of the present invention, a hydrogen-impermeable substance, such as copper may be electrolytically deposited intermediate the matrix element 1 and the screen 4. The copper will thus act as a barrier to any hydrogen which is generated during the electro-deposition of the above-described substances.

Figure 5:
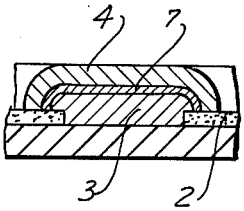
FIG. 5 is a partially broken-away sectional view of the method at one stage in a modified process.
Figure 6:
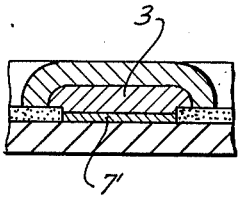
FIG. 6 is a partially broken-away sectional view of another modification of the method at one stage in the modified process.
Figure 7:
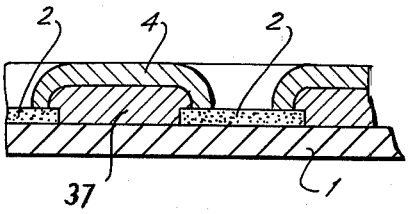
FIG. 7 is a partially broken-away section view of still another modification of the method at one stage in a modified process.

FIGS. 5 – 7 illustrate three different locations at which the copper mayy be deposited. FIG. 5 shows that the hydrogen-impermeable substance 7 may be electrolytically deposited over the side of the inserts 3 which faces away from the matrix element 1. FIG. 6 shows that the substance 7′ may be electrolytically deposited over the side of the inserts 3 which faces towards the matrix element 1. Finally, FIG. 7 illustrates tht the step of overfilling the depressions and the step of providing a hydrogen-impermeable barrier may be simultaneously performed by electro-depositing copper itself into the depressions. In other words, the copper 37 serves the dual roles of being the molding substance and the hydrogen-impermeable substance as well.

Those skilled in the art will recognize that although electrolytic-deposition of the respective substances is a preferred technique, other techniques such as chemical autocatalytic techniques may also be utilized.

The shear foil produced in accordance with the invention has the following characteristics: increased wear resistance, an increase of approximately 10 times in the working life of the shear foil, the ductility is not disadvantageously influenced, the danger of breakage is highly reduced, a considerable reduction is realized in the friction coefficient, the effect of the cutting edge is multiplied many times over, and additional machining of the shear foil is no longer necessary.

In order to further set forth the invention with still greater particularity, the following example is set forth.

EXAMPLE

A matrix plate element is electrolytically cleaned and degreased and placed in a bath comprised per liter of aqueous solution of 300 grams of nickel sulfate, 35 grams of boric acid, 50 grams of nickel chloride, and 1 gram of benzoic acid sulfamide-sodium salt. The bath is maintained with lauryl sulfate at a surface tension of 33 dynes and at a temperature of 50° and also at a current density of 4 amps/dm$^2$ for a time period of approximately 2 hours. Nickel is then electrolytically deposited on the matrix element until it builds to a thickness of approximately 120 microns. Conventional photo-resist film material is coated in known manner over the matrix element; and certain portions of the film corresponding to a predetermined grid pattern are exposed to light, developed, hardened, removed and passivated with a 1% chromic acid solution. Thus, a grid of depressions is provided on the matrix element.

A molding substance, such as nickel is now electrolytically deposited to fill these depressions by using a plating bath comprised, per liter of aqueous solution, of 250 grams of copper sulfate and 50 grams of sulfuric acid, with a current density of 4 amps/dm$^2$ to a thickness of about 25 microns for a time period of about one-half hour and prepared with a 1% chromic acid solution. Thus the depressions are filled with a plurality of inserts.

Thereupon, a layer of screen-forming substance such as nickel is electrolytically deposited over the molding substance from a plating bath comprised per liter of aqueous solution of 60 grams of nickel sulfamate, 30 grams of boric acid, 10 grams nickel chloride, 0.5 grams of cumarin, and 1 gram of benzoic acid sulfamide-sodium salt. The bath is maintained with lauryl sulfate at a surface tension of 33 dynes and at a temperature of 50° C and also at a current density of 4 amps/dm$^2$ for electro-deposition for a time period of approximately 45 minutes. Thus, a screen is formed and a platinum layer is electrolytically deposited over the screen in conventional manner. Then, the platinum layer is coated over with a bitumen lacquer in conventional manner.

Thereupon, the matrix element is separated from the screen and the plurality of inserts. In a 3% aqueous solution of hydrochloric acid the screen and the plurality of inserts are cathodically activated for a time period of approximately 1 minute with a current dennsity of 2 amps/dm$^2$. Next, a hard chrome layer of about 3 microns is electrolytically deposited on the exposed underside of the screen and inserts by employing a plating bath comprises per liter of aqueous solution of 300 grams of chromium tri-oxide and 1 gram of sulfuric acid at a temperature of 55° C for about 10 minutes at a current density of 60 amps/dm$^2$. Thereafter, the bitumen layer is removed with perchloroethylene, and then the inserts are separated from the screen.

It will be understood that each of the element described above, or two or more together, may also find a useful application in other types of constructions differing from the types described above.

While the invention has been illustrated and described as embodied in a shear foil and method of making the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of making a shear foil, comprising the steps of providing a matrix element with a plurality of isles which are separated by a shallow grid-spaced recess and which have a matrix surface; overfilling said recess with a molding substance and forming a plurality of inserts each of which overlaps a narrow annular region of said matrix surface; depositing a layer of screen-forming substance over said inserts and forming a screen having a plurality of openings which extend to said matrix surface intermediate respectively adjacent inserts, said screen also having a face comprised of annular face portions each of which surrounds one of said inserts and is juxtaposed with said matrix surface; separating said matrix element and the isles from said screen and said insert and exposing said inserts and said face; depositing a layer of wear-resistant substance over said exposed face and inserts; and removing the portion of said wear-resistant layer deposited on said inserts, while leaving the remaining portion of said wear-resistant layer on said annular face portions, by separating said inserts from said screen.

2. A method as defined in claim 1, wherein said step of overfilling said recess with a molding substance, said step of depositing a layer of screen-forming substance, and said step of depositing a layer of wear-resistant substance all comprise the step of electro-depositing the respective substance.

3. The method as defined in claim 1, wherein said step of overfilling said recess with a molding substance comprises electro-depositing nickel into said recess.

4. A method as defined in claim 1, wherein said step of depositing a layer of wear-resistant substance comprises electro-depositing chrome over said exposed face and inserts.

5. A method as defined in claim 4, wherein said step of electro-depositing chrome includes building up the latter to a thickness ranging from at least 1 to at most 5 micrometers.

6. A method as defined in claim 1; and further comprising the step of depositing a layer of sealing material over the surface of said screen which faces away from said matrix surface of said isles, prior to the separating step.

7. A method as defined in claim 1; and further comprising the step of depositing a layer of hydrogen-impermeable substance intermediate said matrix element and said screen.

8. A method as defined in claim 7, wherein said step of depositing a layer of hydrogen-impermeable substance comprises electro-depositing the latter intermediate said inserts and said screen.

9. A method as defined in claim 7, wherein said step of depositing a layer of hydrogen-impermeable substance comprises electro-depositing the latter intermediate said inserts and said matrix element.

10. A method as defined in claim 7, wherein said step of depositing a layer of hydrogen-impermeable substance is performed simultaneously with said step of overfilling said depressions.

11. A shear foil, particularly for use in electric shavers, comprising a screen having a plurality of screen elements wjhich bound a plurality of screen openings, each screen element having an annular projection and an annular face portion at a free end of the respective annular projection; and a layer of metallic wear-resistant material overlying all of said annular face portions of said screen, said layer having a lip surrounding a marginal edge portion of each annular projection adjacent each annular face portion.

12. A shear foil as defined in claim 11, wherein said layer of metallic wear-resistant material constitutes chrome electro-deposited at said annular face portions to have a thickness of at least 1 and at most 5 micrometers.

13. A shear foil as defined in claim 11, wherein each lip of metallic wear-resistant material extends at least in part into opening.

* * * * *